US006113706A

United States Patent [19]

Kawanobe

[11] Patent Number: 6,113,706

[45] Date of Patent: Sep. 5, 2000

[54] METHOD OF WASHING A BLIND

[75] Inventor: Norio Kawanobe, Mito, Japan

[73] Assignee: Daitoh System Company Limited, Hitachinaka, Japan

[21] Appl. No.: 09/236,569

[22] Filed: Jan. 26, 1999

[30] Foreign Application Priority Data

Jan. 27, 1998 [JP] Japan ..... 10-030592

[51] Int. Cl.[7] ..... B08B 3/12

[52] U.S. Cl. ..... 134/1; 134/6; 134/7; 134/9; 134/29

[58] Field of Search ..... 134/1, 6, 7, 9, 134/29

[56] References Cited

U.S. PATENT DOCUMENTS

| | | | |
|---|---|---|---|
| 4,897,122 | 1/1990 | Schreiber et al. | 134/254 |
| 5,062,438 | 11/1991 | Micheletti | 134/9 |
| 5,700,328 | 12/1997 | Kawanobe | 134/1 |

FOREIGN PATENT DOCUMENTS

| | | |
|---|---|---|
| 64-5512 | 1/1989 | Japan . |
| 4-208127 | 7/1992 | Japan . |
| 5-38316 | 2/1993 | Japan . |
| 9-28627 | 2/1997 | Japan . |

*Primary Examiner*—Zeinab El-Arini
*Attorney, Agent, or Firm*—Wenderoth, Lind & Ponack, L.L.P.

[57] ABSTRACT

A method of washing a blind including the steps of contracting the blind while inserting offset ring-like portions of a coil-spring-like spacer formed of a wire having a specified diameter between adjacent louvers. The blind is then placed in a washing bath in a state where a gap, corresponding to the diameter of the wire, is formed between adjacent louvers. The blind is then placed on a fine particle layer of a mixed material. A vibration generator is driven to apply a vibration to the mixed material through the washing bath so that the fine particles in the mixed material are liquefied. The blind is then sunk into the fine particle layer due to its own weight through the liquefaction. The dirty materials deposited on the surfaces of the louvers are removed by the brushing action of the fine particles, which move in contact with the surfaces of the louvers. The above method is capable of satisfactorily removing even dirty materials that are insistently adhesively deposited on the surfaces of louvers in a short time by a simple operation.

9 Claims, 12 Drawing Sheets

METHOD OF WASHING A BLIND

BACKGROUND OF THE INVENTION

1. Field of the Invention

The present invention relates to a method of washing a blind, which is widely used by attaching it to the window of an ordinary house, an office, a factory, and the like for preventing the entrance of exterior light.

2. Description of Related Art

Various types of dust or similar dirty materials, of which kind varies depending on the particular environment, are likely to be adhesively deposited on louvers constituting a blind, and it is not easy to remove the dust from the louvers. With a small number of blinds, it is not impossible to wash each louver with an operator's hands using a mop. At any rate, it is not easy to wash the louvers of the blind.

In view of the foregoing fact, there has been proposed the following blind washing method (Japanese Unexamined Patent Publication No. 64-5512.

Specifically, the prior art method of washing a blind with plate-like light shading louvers arranged in parallel to each other with adjustable distance held between adjacent louvers, includes inserting while the adjacent louvers are sufficiently parted away from each other, a rod-like insert projecting from the surface of a flexible belt base material between the adjacent louvers.

Thereafter, the blind is folded and the distance between the adjacent louvers is reduced while the rod-like insert is inserted into the folded blind, and then the folded blind is washed in a washing liquid.

An advantage of the prior art method is that since the distance between the adjacent louvers is reduced to a necessary minimum extent, the height as measured in the vertical direction is reduced and then the blind is washed, a washing operation can be achieved with a comparatively small washing apparatus.

However, since a means usable for reducing the distance between the vertically adjacent louvers to a necessary minimum extent is a rod-like insert projecting from the surface of a flexible belt-like base material, the forgoing means has the following problems.

According to the known method, while the blind is expanded in the vertical direction, the belt-like base material comes in contact with the blind, and the rod-like insert is inserted into the adjacent louvers. However, for the reason that the distance between the adjacent louvers of one blind can not be always adjusted to be constant at all times, there arises a problem in that all the rod-like inserts are not always inserted between the vertically adjacent louvers when the belt-like base material only comes in contact with the blind. Another problem is that in many cases, when an operator checks the entire blind after the completion of the aforementioned operation, he often finds that many rod-like inserts are incorrectly inserted between the adjacent louvers, and there arises the necessity to manually insert the rod-like inserts between the incorrectly inserted adjacent louvers. Thus, a further problem is that when the conventional method is employed, each inserting operation is insufficiently performed and rod-like inserts are inconveniently used.

The inventor has solved the above problem and proposed a blind washing method (Japanese Unexamined Patent Publication No. 9-28627, U.S. Pat. No. 5,700,328) that is capable of easily obtaining the necessary minimum distance between the adjacent louvers of a blind and accordingly easily and reliably removes dirty materials with a small washing means.

Specifically, the method comprises the steps of:

enlarging a distance between adjacent louvers of a blind to be washed, each of the louvers being held in a horizontal orientation;

pressing a coil spring spacer against the blind so as to insert offset ring-like portions (that is, an amount of one pitch) of the coil spring spacer between the adjacent louvers, wherein the coil spring spacer is disposed at a right angle relative to the louvers and is formed of a wire having a diameter;

reducing the distance between adjacent louvers of the blind so as to hold the offset ring-like portions in a clamped state such that a gap, corresponding to the wire diameter, is formed between the adjacent louvers;

washing the blind while maintaining the gap between the adjacent louvers;

removing the coil spring spacer from the blind; and drying the blind.

This prior art method completely solves the problem associated with the prior art method disclosed in Japanese Unexamined Patent Publication No. 64-5512, in that the step for reducing the distance between the respective louvers of the blind to a necessary minimum extent can be very simply and reliably executed. Accordingly, since a washing job can be performed with a small washing means, it can be said that the method of JP 9-28627 is very excellent in the achievement of the intended object.

However, the method of JP9-28627 employs such washing technologies as to move a washing liquid in which a blind is dipped, transmit a supersonic vibration to the washing liquid, wash the blind with a brush while injecting the washing liquid to the blind, and the like as an influential washing technology in the washing step. Thus, JP9-28627 does not particularly exceed an ordinary technical level in the washing step itself. That is, although the prior art method can generally remove ordinary dirty materials, there are some cases that they cannot perfectly remove insistently adhesively deposited dirty materials, and thus it is required to manually remove remaining dirty materials with a brush or the like. Further, the washing step still has a certain degree of room for improvement in the simplicity of a washing job.

SUMMARY OF THE INVENTION

Accordingly, it is an object of the present invention to provide a method of washing a blind which has a washing capability for reliably removing even insistent dirty materials such as strongly deposited dirty materials, and the like which would not be easily removed by an ordinary washing technology while completely inheriting the advantage of the prior art method as well as permitting a washing job to be performed easily.

According to the present invention, there is provided a method of washing a blind comprising the following steps:

enlarging a distance between adjacent louvers of a blind to be washed, each of the louvers being held in a horizontal orientation;

squeezing a coil-like-spring spacer against the blind so as to insert offset ring-like portions of the coil-like-spring spacer between the adjacent louvers, wherein the coil-like-spring spacer is disposed at right angles relative to the louvers and is formed of a wire having a diameter;

reducing the distance between adjacent louvers of the blind so as to hold the offset ring-like portions in a clamped state such that a gap, corresponding to the wire diameter, is formed between the adjacent louvers;

washing the blind by putting the blind provided with the louvers having the reduced distance into a washing bath filled with a mixed material of fine particles and a liquid, causing liquefaction to the fine particles by applying a varying external force to the fine particles so that dirty materials on the surfaces of the louvers of the blind are removed by the brushing action of the fine particles caused by the liquefaction; and disconnecting the coil-spring-like spacer member from the washed blind.

In the method of washing a blind, the coil-spring-like spacer member should not be limited to only an annular contour as seen in a plan view, and it may exhibit the contour of, e.g., a triangle, a rectangle, a pentagon, or the like. Although the coil-spring-like spacer member exhibits a polygon, it is preferable that each corner of the polygon is rounded.

It is acceptable that the diameter of the wire forming the coil-spring-like spacer member is set to a size which sufficiently exceeds the particle size of the fine particles. It is necessary to secure a space between the louvers through which the brushing action of the fine particles caused by the liquefaction can be sufficiently applied. For this purpose, it is preferable that the diameter of the wire is at least twice the particle size of the fine particles. For example, when the particle size of the fine particles is set to about 0.7–0.9 mm, the diameter is suitably set to at least 2 mm.

When the distance between the louvers exceeds the diameter of he fine particles, the fine particles can enter between the louvers. Therefore, it is sufficient that the minimum diameter of the wire slightly exceeds the particle size of the fine particles.

Although a material for the coil-spring-like spacer member can be selected from various kinds of materials, the coil-spring-like spacer member can be molded of a plastic material or a similar non-metallic material to prevent the surface or the coating layer of a part of the louver from coming into contact with the coil-spring-like spacer member and being injured by it in a washing step.

It is suitable that the diameter of the offset ring-like portion associated with the coil-spring-like spacer member is dimensioned to a size corresponding to the width of the louver, i.e., within the range from slightly short of the width of the louvers to lightly long of the same.

It is preferable to use fine particles having a surface layer softer than the surface of the louvers of the blind as the fine particles. This is for the purpose of avoiding the disadvantage that, when the brushing action is caused by the fine particles that are brought in contact with the surfaces of the louvers by the liquefaction so as to remove the dirty materials on the surfaces of the louvers, the surfaces of the louvers are injured by the brushing action. It is adequate that the core of each of the fine particles is composed of a rigid body different from the surface layer. This is because it is convenient that each of the fine particles is composed of the rigid body in order to transmit a varying external force, which is applied to the fine particles to cause the liquefaction, to the fine particles as a whole.

Silica sand, for example, can be employed as the fine particles and it is adequate that the silica sand has a particle size of 0.5–0.8 mm from the view point that it can easily cause liquefaction and wash the adjacent louvers of a blind having a relatively narrow distance of about 2 mm.

Further, silica sand, the surface layer of which is subjected to a softening process, must be employed for the purpose of preventing the surfaces of the louvers from being injured by the brushing action of the particles.

The surface layer of the silica sand can be easily softened by dipping the silica sand into a caustic soda solution and modifying the surface layer with sodium silicate.

The above liquid can be suitably selected in accordance with the property and degree of the dirty materials deposited on the blind. For example, the degree of the dirty materials is relatively low and they can be dissolved in water, then simple water can be used as the liquid.

Further, when water cannot sufficiently wash the dirty materials, a suitable detergent solution can be employed in accordance with the property and degree of the dirty materials deposited on the surfaces of the louvers. When the detergent solution is employed, it cannot be avoided that the detergent solution deposited on the surfaces of the louvers in the washing step somewhat remains on the surfaces. To cope with this problem, a rinsing step must be added between the washing step and the spacer disconnecting step, or after the spacer disconnecting step to rinse the washed blind.

Although a simple box-like bath may be employed as the washing bath, it is preferable to employ a double-wall type bath composed of an outer bath and an inner bath disposed in the outer bath. The inner bath must have a space sufficient to accommodate the blind to be washed, and the four side plates of the inner bath have communicating holes opened therethrough for communicating with the outer bath. The holes are located at positions higher than the upper surface layer of the fine particles charged into the inner bath so that only the liquid in the inner bath flows out to and flows in from the outer bath.

When the simple box-like bath is employed as the washing bath and a varying external force, for example, a vibration is applied to the bath to cause liquefaction to the mixed material of the fine particles and the liquid charged into the bath, the surface of the fine particle layer is not always made flat and is likely to be partly bulged. When the surface of the fine particle layer is bulged, there may arise a disadvantageous phenomenon that the blind cannot sink well in the fine particle layer and accordingly the brushing action cannot be sufficiently obtained.

When, however, the washing bath is composed of the double-wall type bath having the inner bath and the outer bath and the communicating holes communicating with the outer bath are opened through all the side plates of the inner bath and the varying external force, for example, the vibration is applied to the double-wall type bath so as to generate the liquefaction of the mixed material of the fine particles and the liquid charged into the inner bath, the fine particles and the liquid are moved in accordance with the vibration. At this time, the stress resulting from the collision of the liquid in the inner bath against the side plates, which is caused by the above movement, can be dispersed by moving a part of the liquid in the inner bath into the outer bath through the communicating holes and returning a part of the liquid in the outer bath into the inner bath in accordance with the above movement.

The varying force is not limited to a specific one and any varying forces can be employed so long as they can generate the liquefaction of the fine particles. It is convenient to cause the external force more simply and a vibration can be suitably employed. A vibration having a proper frequency and amplitude can be simply generated making use of an eccentric motor, or the like. Otherwise, a similar vibration can be generated by causing a linear motion by making use of the principle of a linear motor.

According to the method of washing a blind of the present invention, a blind can be simply, satisfactorily and quickly washed by the following steps.

First, the spacer inserting step will be executed.

For example, the blind is expanded while it is engaged with a window, and the distance between the adjacent louvers is expanded to a maximum extent. A part of the offset ring-like portions corresponding to the coil-spring-like spacer member is inserted between the vertically adjacent louvers by squeezing the coil-spring-like spacer member against the blind of which distance is enlarged in the above-mentioned manner. It is preferable to dispose a plurality of the coil-spring-like spacer members at suitable intervals essentially in accordance with the lateral width of the blind (the length of the louver).

In the case that the coil-spring-like spacer member is suspended while its upper end is supported, the coil-spring-like spacer member has a length such that the upper end of the coil-spring-like spacer member substantially corresponds to the upper end of the blind to be washed and its lower end substantially corresponds to the lower end of the blind. The number of offset ring-like portions is larger than the number of gaps formed by the louvers. When two coil-spring-like spacer members are used, they are disposed such that each of them corresponds to a position of about ¼ as measured from both the sides of the lateral width of the blind.

When the coil-spring-like spacer member is disposed forward (or backward) of the suspended blind and squeezed against the blind from, e.g., the upper end side, the corresponding part of the offset ring-like portions of the coil-spring-like spacer member is squeezed or positioned between the vertically adjacent louvers of the blind so that it is inserted therebetween.

This will be described in more detail. When the coil-spring-like spacer member, coming into contact with the front surface (or back surface) of the blind, is slightly squeezed toward the blind side by sliding an operator's hand along the coil-spring-like spacer member while the upper end of the blind is supported and suspended, the corresponding offset ring-like portions can be easily inserted between the vertically adjacent louvers in a single operation. Even though the vertically adjacent louvers and the corresponding offset ring-like portions are located at a vertically non-coincident position, since the coil-spring-like spacer member is spirally extended, they are displaced to the vertically coincident position as an operation's hand sides along the coil-spring-like spacer member in that way. Thus, the offset ring-like portions are inserted between the corresponding louvers.

This operation can be very simply and speedily performed without the necessity of manually adjusting the louvers one by one.

Thereafter, the louver distance reducing step will be executed.

The blind, expanded to a maximum extent, is raised up from the lower end of the blind by operating a louver distance expanding/reducing string provided with the blind so that the distance between the vertically adjacent louvers is reduced to a dimension corresponding to the diameter of the wire of the coil-spring-like spacer member.

when the blind is raised up from the lower end thereof to reduce the distance between the louvers, since the offset ring-like portions of the coil-spring-like spacer member are inserted between the vertically adjacent louvers, the vertically adjacent louvers hold the offset ring-like portions in the clamped state, and the reduction of the distance between the louvers is adjusted and held at an adequate smallest limit.

Next, the washing step will be executed.

The blind having the louvers, the distance of which is reduced to the minimum extent with the minimum extent being held, is put into the washing tank which is filled with the mixed material of fine particles and liquid.

Although the simple box-like bath may be employed, there can also be also employed the double-wall type bath composed of the inner bath and the outer bath and having the communicating holes opened through the respective side plates of the inner bath and communicating with the outside bath. As described above, it is preferable to employ the latter double-wall type bath because it can suppress the bulging phenomenon caused on the upper surface of the fine particle layer when the mixed material, with which the washing bath is filled is liquified.

The blind can be put into the washing bath before or after the varying external force is applied to the mixed material of the fine particles and the liquid.

When the blind is put into the washing bath before the varying external force is applied, since the fine particles are not yet liquefied and the respective particles are coupled with each other through the liquid to form a layer-like solidified state as a whole, the blind is placed on the upper surface of the fine particle layer. When the varying external force is applied to the mixed material containing the fine particles through the washing bath or directly, since the fine particles are liquefied, the blind placed on the upper surface of the solidified fine particle layer sinks into the fine particles due to its own weight and is buried in the fine particles.

When the blind is put into the washing bath while the varying external force is applied to the mixed material including the fine particles, since the fine particles are already liquefied, the blind sinks into the fine particles and is buried therein at once.

It is preferable that the varying external force applied to the mixed material including the fine particles has a varying frequency which is as high as possible when the blind sinks into the fine particles so that the liquefaction can be generated perfectly with a small amount of stress and the blind readily can sink. Whereas, it is preferable, after the blind sinks into the fine particles, that the varying frequency is somewhat lowered and the amount of the stress is increased so that the brushing action, which will be described below, can be satisfactorily executed by the fine particles.

The blind that has sunk into the liquefied fine particles is subjected to the brushing action executed by the fine particles which move in contact with the surface of the louvers as the fine particles are liquefied so that the dirty materials deposited on the surfaces of the louvers are speedily and satisfactorily removed. When the fine particles, at least the surface layer of each of which is softer than the surfaces of the respective louvers are employed, there is no possibility that the surfaces of the louvers will be injured by the fine particles. When, for example, silica sand is used as the fine particles, it suffices only to dip the silica sand into a caustic soda solution and modify the surface layer thereof with sodium silicate as described above.

Water or an adequate detergent liquid can be used as the liquid in accordance with the property and degree of the dirty materials deposited on the surfaces of the louvers as described above. Even if water, for example, is used, when the degree of dirty materials is low and they contain a water soluble component in a large amount, a washing action executed by the water being stirred is also applied to the dirty materials together with the brushing action executed by the fine particles so that a superior washing effect can be obtained. When the water is heated to about 40° at that time, a furthermore excellent washing effect can be obtained in many cases.

When a neutral detergent solution or an alkaline detergent solution is used in accordance with the property and degree of the dirty materials, since both the washing action executed by the water being stirred and the brushing action executed by the fine particles are applied to the dirty materials in combination with each other, even insistent dirty materials can be speedily and satisfactorily removed, and thereby a good washing effect can be obtained.

Although various types of forces such as a vibration, a swing, and the like can be applied as the varying external force for generating the liquefaction of the fine particles, the vibration or the swing in particular can be simply applied making use of the reciprocating motion of a linear motor or the rotating motion of an eccentric motor and the liquefaction of the fine particle layer can be very simply generated by the vibration or the swing. When, silica sand having a particle size of for example, about 0.5 mm–0.9 mm is employed as the fine particles, the liquefaction can be generated by the application of a vibration having a frequency of about 20–60 Hz and an amplitude of about 1.0–2.5 cm to the silica sand and the dirty materials deposited on the surfaces of the louvers of a blind can be very satisfactorily and speedily removed by the brushing action executed by the fine particles of the silica sand which moves in contact with the surfaces of the louvers of the blind.

Thereafter, the blind is pulled up while the varying external force is applied to the fine particles, that is, while the liquefaction of the fine particles is generated. This is because when the varying external force disappears, since inter-particle coupling, in which the respective fine particles are coupled with each other through the liquid, is caused, the fine particles form a solid state as a whole and it is difficult to pull up the blind.

Finally, the spacer disconnecting step will be executed.

There is a case in which the blind having been pulled up need not be particularly rinsed when the liquid which constitutes the mixed material together with fine particles is water. In the case where the coil-spring-like spacer member is disconnected from the blind at once or after the water is drained from the blind, the blind can be dried by being left in this state for some time. The coil-spring-like spacer member can be simply disconnected by being pulled out after the blind is expanded to enlarge the distance between the adjacent louvers by operating a louver distance expanding/reducing string.

When the liquid used in the washing step is a detergent solution, such as the neutral detergent solution, the alkaline detergent solution, or the like, the rinsing step is added between the washing step and the spacer disconnecting step or after the spacer disconnecting step to rinse the pulled-up blind. In operation, it is preferable to add the rinsing step between the washing step and the spacer disconnecting step. In any case, the coil-spring-like spacer member is disconnected as described above.

Thereafter, a drying step can be added when necessary.

The drying step is practiced by expanding the blind to enlarge the distance between the adjacent louvers and engage the upper end of the blind with an engagement means located at a high position. The blind is forcibly dried by hot air blown thereto or naturally dried by being left in a room or outside of the room as it is, as necessary. In some cases, it is sufficient to dry the blind merely by leaving it as is without any particular action being executed.

The washing of the blind is finished as described above. It is not always required to add the drying step.

DESCRIPTION OF THE PREFERRED EMBODIMENT

Figure 1:
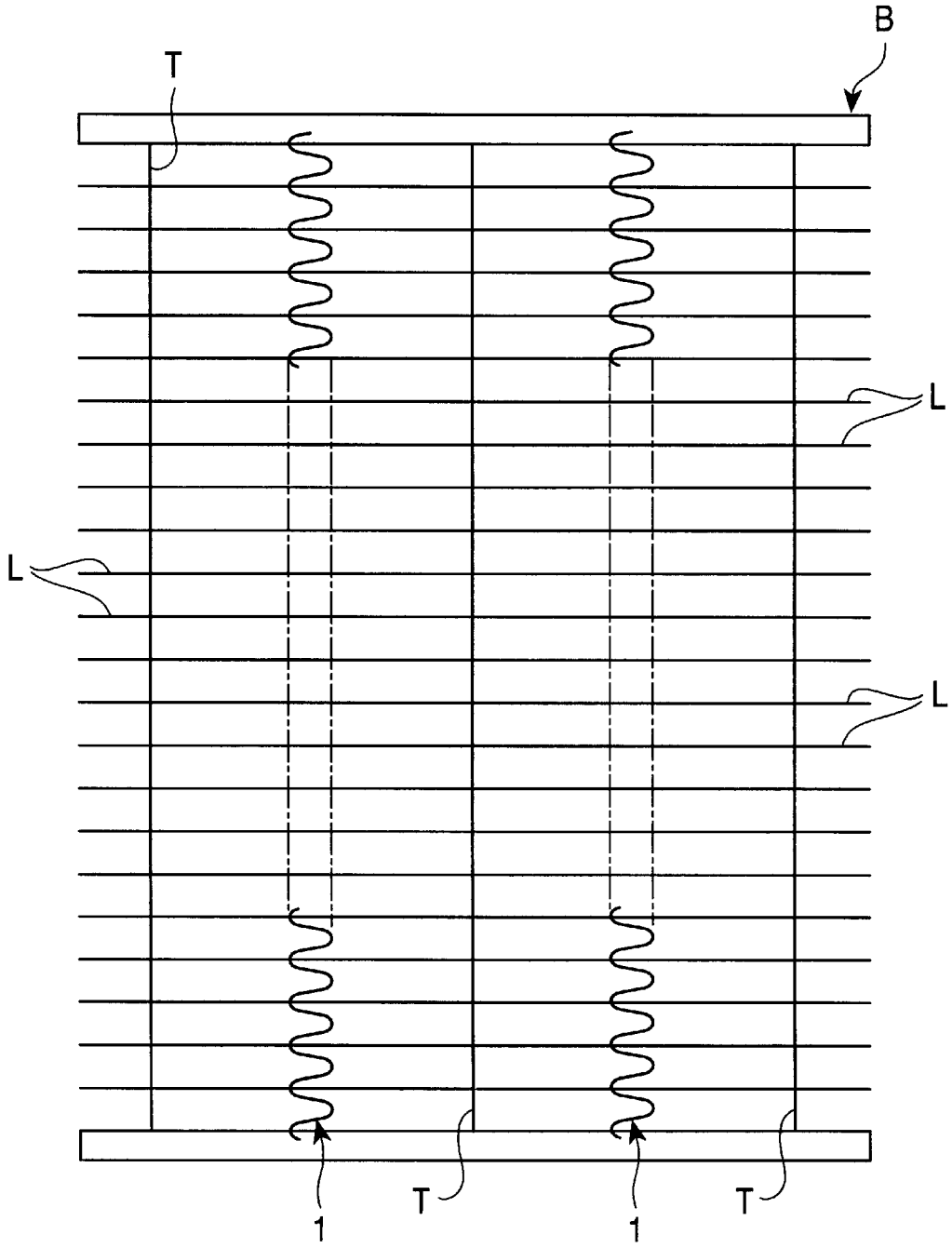
FIG. 1 is an illustrative schematic front elevational view which shows a coil-spring-like spacer engaged with an expanded blind with louvers held in a horizontal state.

A preferred embodiment of the present invention will be described below in detail with reference to the accompanying drawings.

First, essential materials, components, and devices employed in a method of washing a blind of the embodiment, that is, a coil-spring-like spacer (coil-spring-like spacer member) 1, fine particles 3 and a detergent solution 4 which constitute a mixed material 2, a washing bath 5, a washing base 7 provided with a vibration generator 6, and a rinsing bath 8 will be described.

Figure 14:
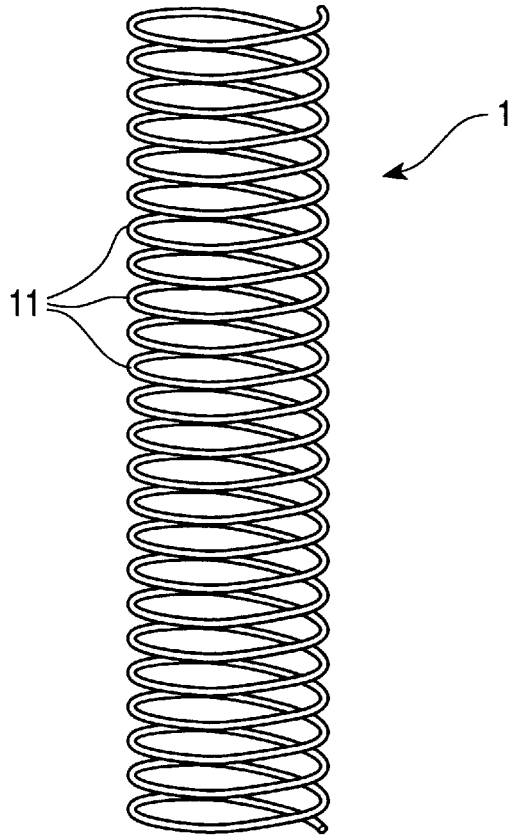
FIG. 14 is a schematic perspective view of the coil-spring-like spacer.

As shown in FIG. 14, the coil-spring-like spacer 1 is literally a coil-like member and it is assumed that the coil-spring-like spacer 1, which is dimensioned to a size of a blind B to be washed, is prepared. The coil-spring-like spacer 1 used in the embodiment which will be described here exhibits an annular contour as seen in a plan view and has a diameter of about 70 mm, and a wire constituting the coil-spring-like spacer 1 has a diameter of 2 mm. The diameter of the coil-spring-like spacer 1 is approximately matched to the distance between adjacent louvers L of the blind B. The number of the offset ring-like portions 11 of the coil-spring-like spacer 1 is set greater than the number of gaps between the louvers L, L . . . of the blind B to be washed, and the offset-ring-like portions 11 are molded of an elastic plastic material so as to have elasticity.

Figure 15:
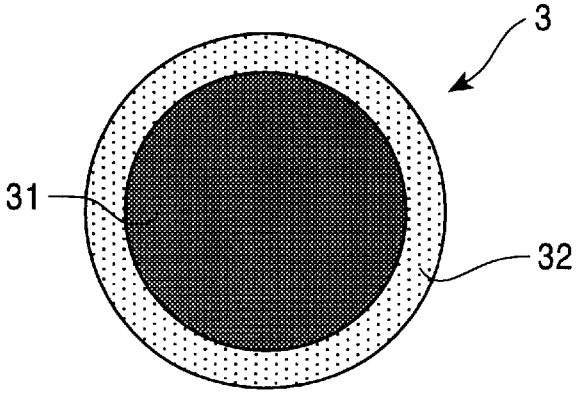
FIG. 15 is an enlarged sectional view schematically showing the fine particles.

Silica sand having a particle size of 0.5–0.8 mm is used as the fine particles 3. As shown in FIG. 15, the surface layer of each of the fine particles 3 is subjected to a softening process so that the particle is composed of a hard core 31 as a hard central portion and a soft surface layer 32 surrounding the outside periphery of the hard core 31. The soft surface layer 32 is made slightly softer than the surface coating of the blind B to be washed. The surface layer of the fine particle 3 is by dipping the silica sand into a caustic soda solution so that the surface layer thereof is modified with sodium silicate. The caustic soda used in the softening process has a concentration of 0.5 mol/1, and the silica sand is dipped into the caustic soda solution for 60 minutes and thereafter washed with water until the pH of the silica sand is 12–13.

In the embodiment, an alkaline washing solution is used as the detergent solution 4 constituting the mixed material 2 which is prepared by being mixed with the fine particles 3. Since the blind B to be washed is used in an ordinary office, the content of dirty materials generally comprises dust, tar of tobacco and the like. Thus, the alkaline washing solution will be used as the detergent solution 4.

Figure 8:
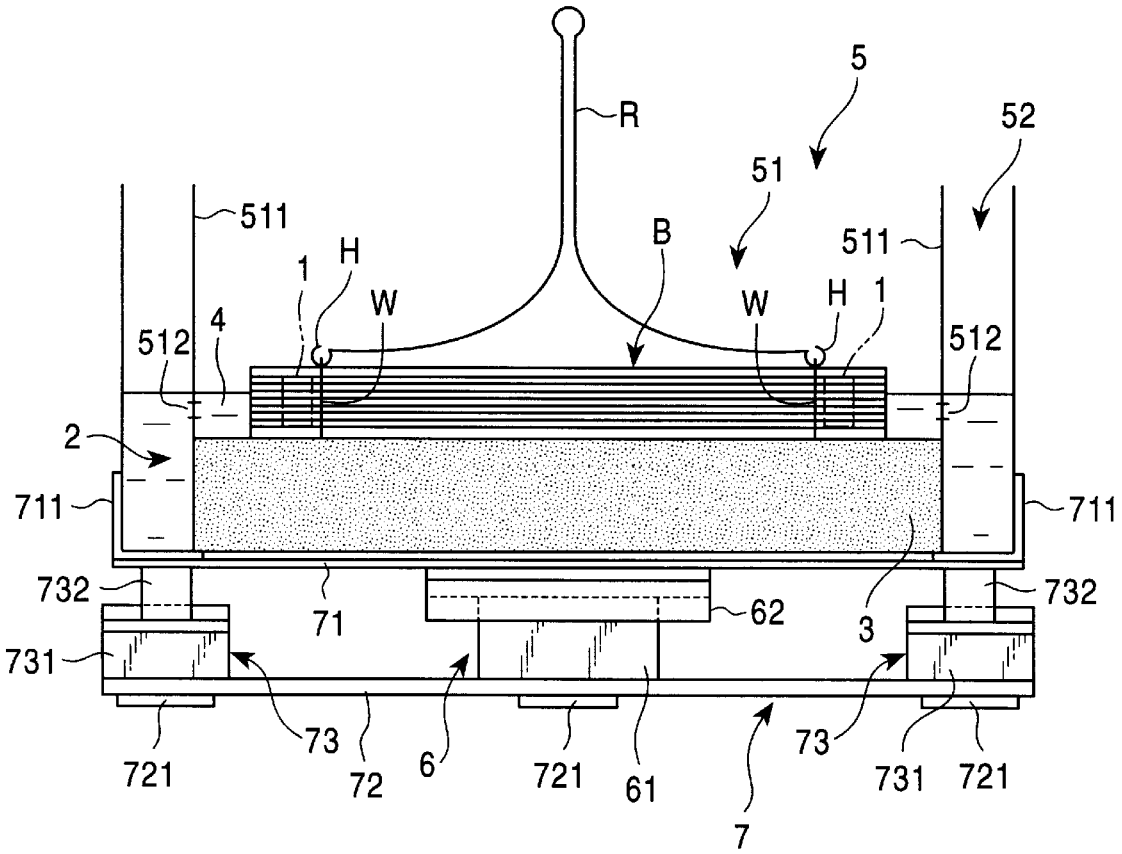
FIG. 8 is an illustrative side elevational view of the blind which is disposed in a washing bath in a contracted state with a vibration generator not driven in a state that the offset ring-like portions of the coil-spring-like spacer are inserted between the adjacent louvers of the blind.

The fine particles 3 and the detergent solution 4 are mixed with each other to constitute the mixed material 2, and the washing bath 5 is filled with the mixed material 2, as shown in FIG. 8.

Figure 16:
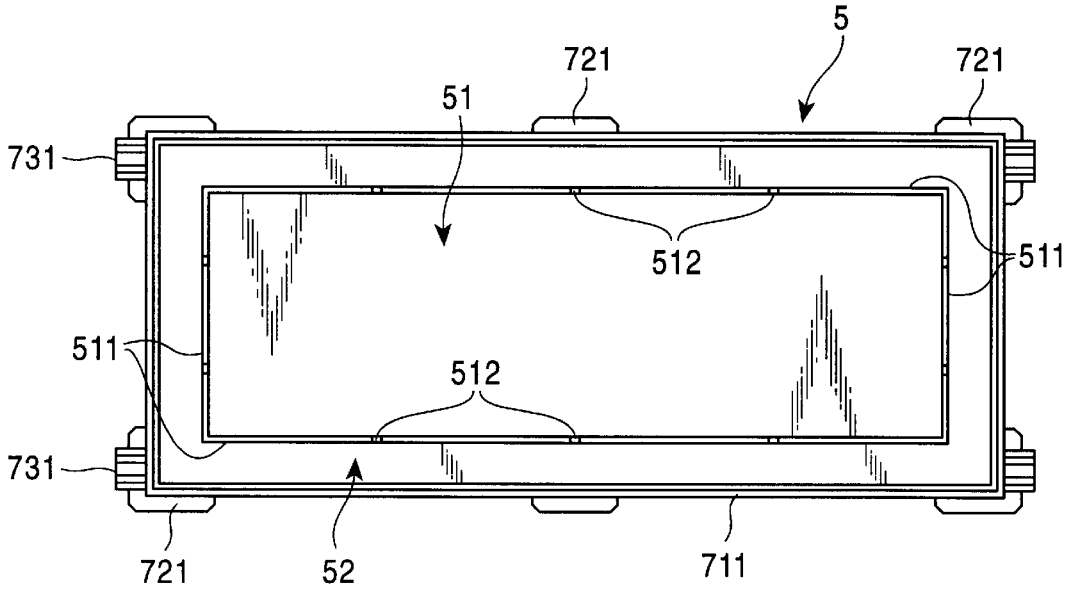
FIG. 16 is a schematic plan view of the washing bath.
Figure 17:
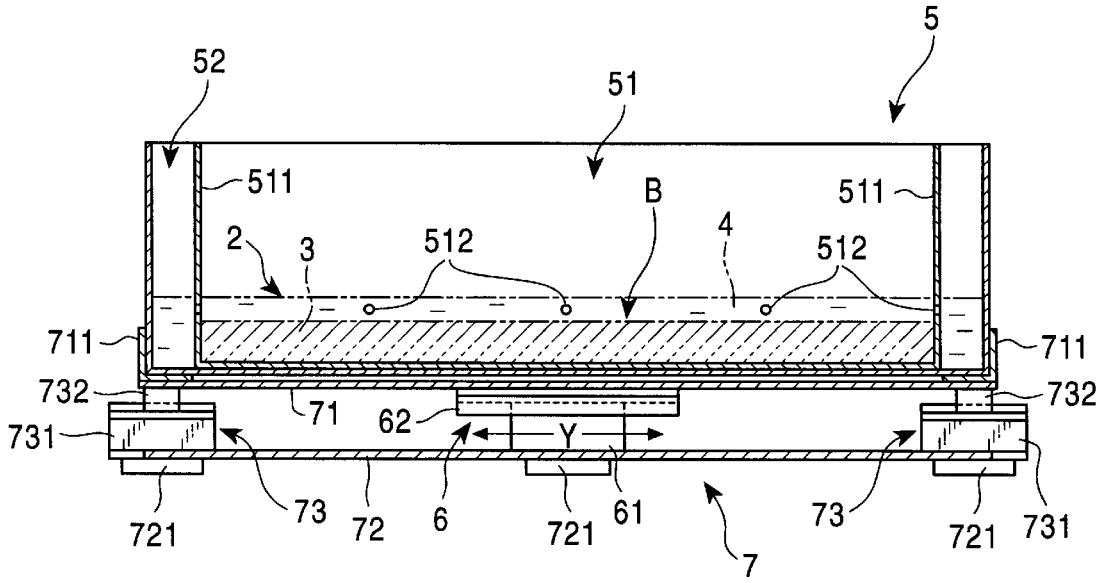
FIG. 17 is a schematic sectional view of the washing bath supported on a washing base.

As shown in FIG. 16 and FIG. 17, the washing bath 5 is a box-like double-wall type bath composed of an inner bath 51 and an outer bath 52. The inner bath 51 is disposed in the outer bath 52. As shown particularly in FIG. 8 and FIG. 9, the inner bath 51 has a volume sufficient to accommodate the blind B therein and wash it. In the illustrated embodiment, the specific inside dimension of the inner bath 51 has a specific dimension of 400 mm depth×400 mm width×2100 length. Since it is assumed that the fine particles 3 are charged into the inner bath 51 up to the height of 100 mm, communicating holes 512 having a diameter of 10 mm are opened through the four side plates 511 of the inner bath 51 at positions of 115 mm high, which exceeds the level of the fine particles 3, as shown in FIG. 16 and FIG. 17. Three communicating holes 512 are formed in each of the slide plates 511 in the lengthwise direction at prescribed intervals, whereas two communicating holes 512 are formed in each of the slide plates 511 in a width direction at positions spaced apart from both the ends thereof by a prescribed distance.

Figure 9:
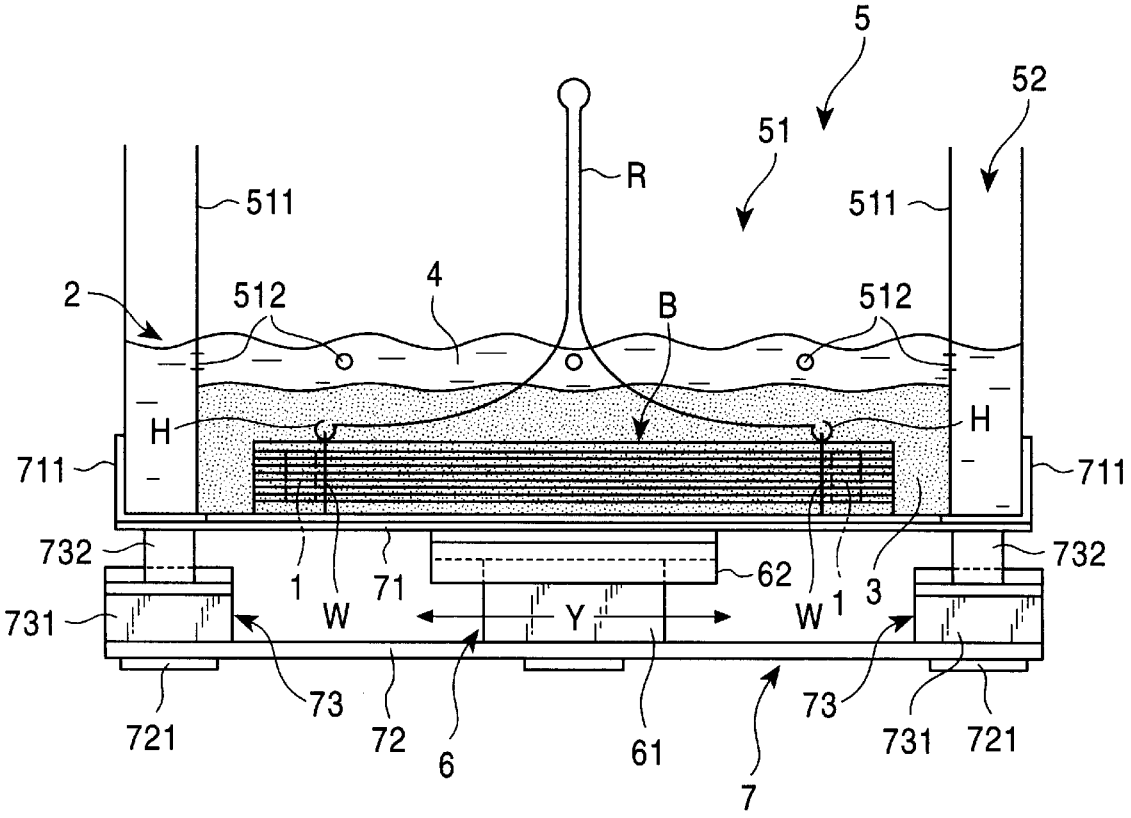
FIG. 9 is an illustrative side elevational view of the blind which shows a state in which liquefaction of the fine particles is generated in the washing bath by driving the vibration generator and the blind, which is contracted, is buried in the fine particles.

In the embodiment, the vibration generator 6 generates a reciprocating motion making use of the principle of a linear motor and generates a vibration from the reciprocating motion. As shown in FIG. 8, FIG. 9 and FIG. 17, the vibration generator 6 is interposed at a central location between the lower surface of a placing or supporting board 71 which constitutes the upper portion of the washing base 7 and the upper surface of a base board 72 which constitutes the lower portion of the washing base 7. As shown in FIG. 9 and FIG. 17, the vibration generator 6 is arranged such that an upper movable section 62 vibrates and moves on a lower vibration generator main body 61 in the direction of an arrow Y. It is needless to say that the lower section of the vibration generator main body 61 is fixed to the base board 72 and the upper section of the upper movable section 62 is fixed to the placing board 71.

As shown in FIG. 17, the washing base 7 is composed of the placing board 71, having a dimension in a plan view which is suitable to place the washing bath 5 thereon, the base board 72 having a dimension in a plan view which is approximately similar to that of the placing board 71, and movable leg members 73 for supporting the placing board 71, which is located above the base board 72, between the four corners of the base board 72 and the movable leg members 73.

As shown in FIG. 8, FIG. 9 and FIG. 17, an angle member 711 is disposed on the placing board 71 along the four sides thereof so as to fix the washing bath 5 therein. The angle member 711 may be provided with a means such as a vise or the like when necessary so that the washing bath 5 can be more securely fixed in the angle member 711.

As shown in FIG. 8, FIG. 9 and FIG. 17, each of the movable leg members 73 is composed of a leg main body 731 fixed to the base board 72 and a movable section 732, which is disposed on the leg main body and can move a rail-like member disposed on it in the same direction as the direction of the arrow Y. The upper portion of the movable section 732 is of course coupled with the lower surface of the placing board 71.

As shown in FIG. 8, FIG. 9 and FIG. 17, bases 721 are disposed at the four corners of lower portions of the base board 72 and at the midpoints of both sides of the base board 72 in the lengthwise direction thereof, respectively.

Figure 11:
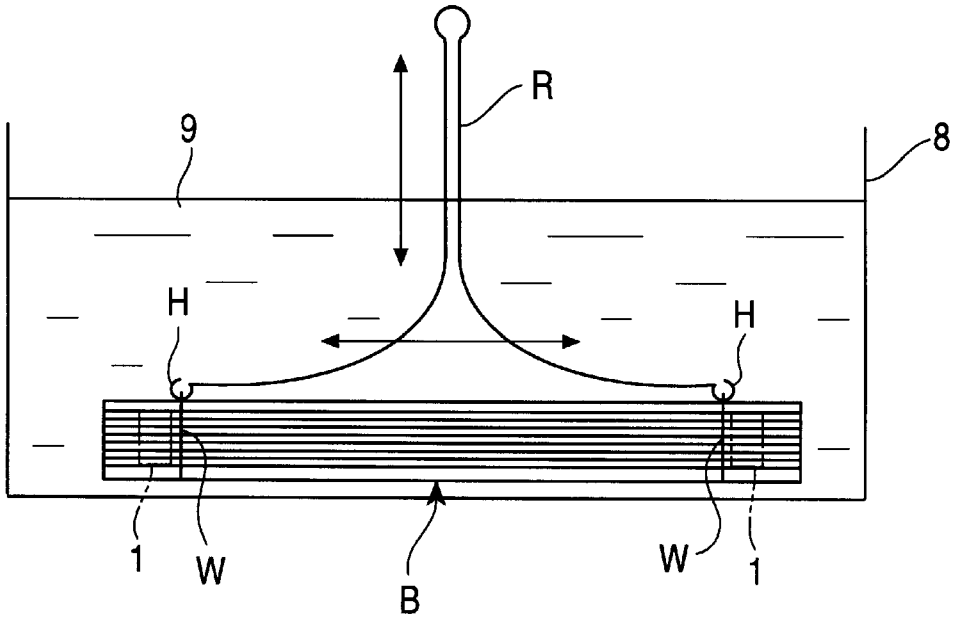
FIG. 11 is an illustrative side elevational view showing a state in which the washed blind is put into a rinsing bath.

As shown in FIG. 11, the rinsing bath 8 is a box-like bath for accommodating a rinsing liquid 9 and has a volume that is sufficient to dip the blind B therein. Although the rinsing liquid 9 may be simple water, an aqueous solution containing a rinsing agent and a draining agent is used in the illustrated embodiment.

In the figures, symbol T denotes strings or the like for coupling the louvers L of the blind B and adjusting the distance and angle thereof.

According to the embodiment, the blind B is washed using the above-described materials, components, and devices.

Figure 13:
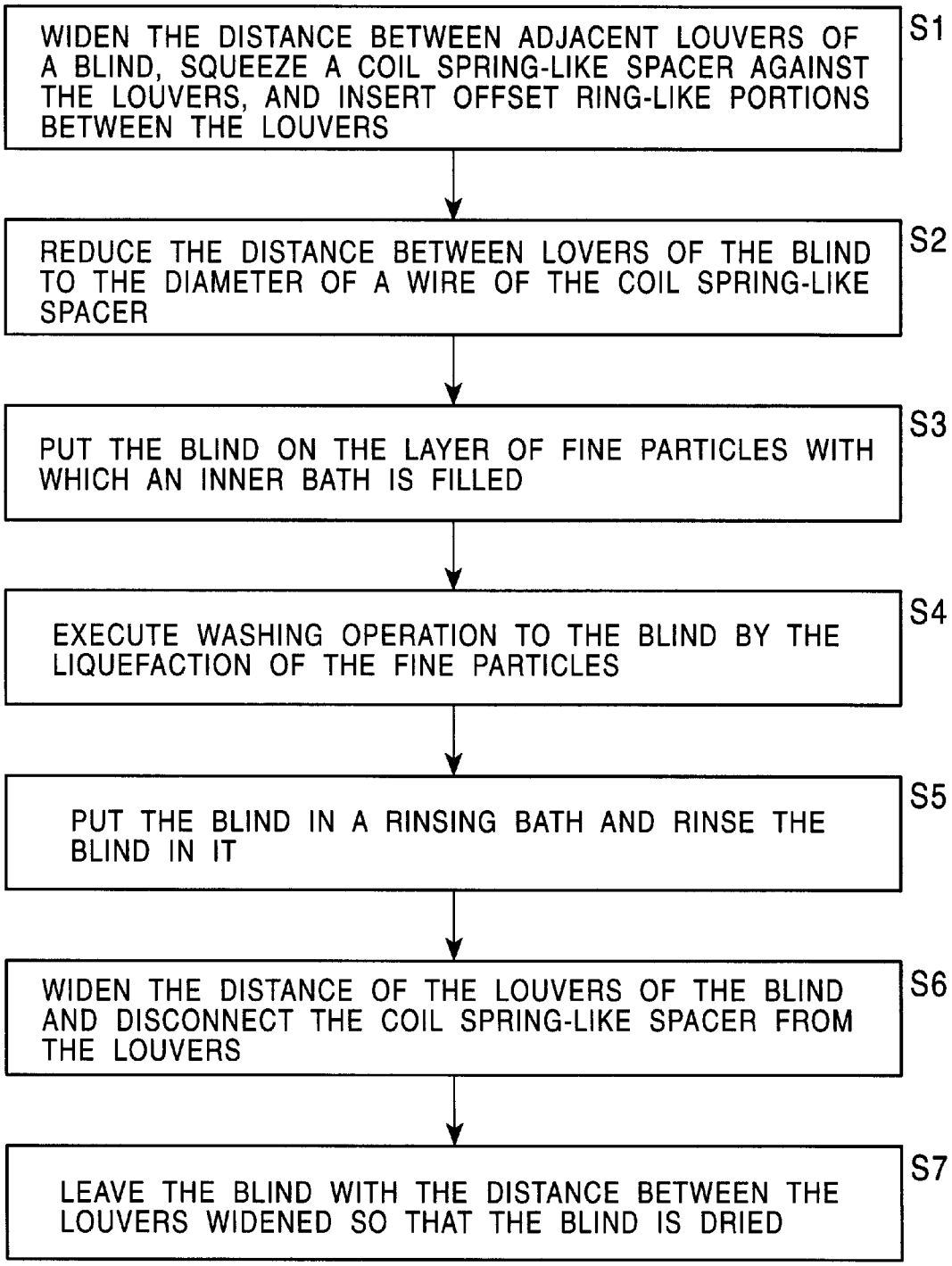
FIG. 13 is a flowchart showing the steps of the process of an embodiment of the present invention.

First, a spacer inserting step will be executed as shown at step S1 of FIG. 13.

As shown in FIG. 1, the blind B is expanded to a maximum extent such that the window is covered with the blind B in conformance with a manner of usage thereof, the distance between adjacent louvers is enlarged to a maximum extent, while the louvers are held in a horizontal state, two coil-spring-like spacer members 1, 1 are positioned against the blind B with a vertical attitude so that the offset ring-like portions 11 are inserted between adjacent louvers L of the blind B located one above another.

The two coil-spring-like spacer members 1 are located at positions spaced from the opposite ends of the blind B by a distance of one quarter of the width of the blind B.

Figure 2:
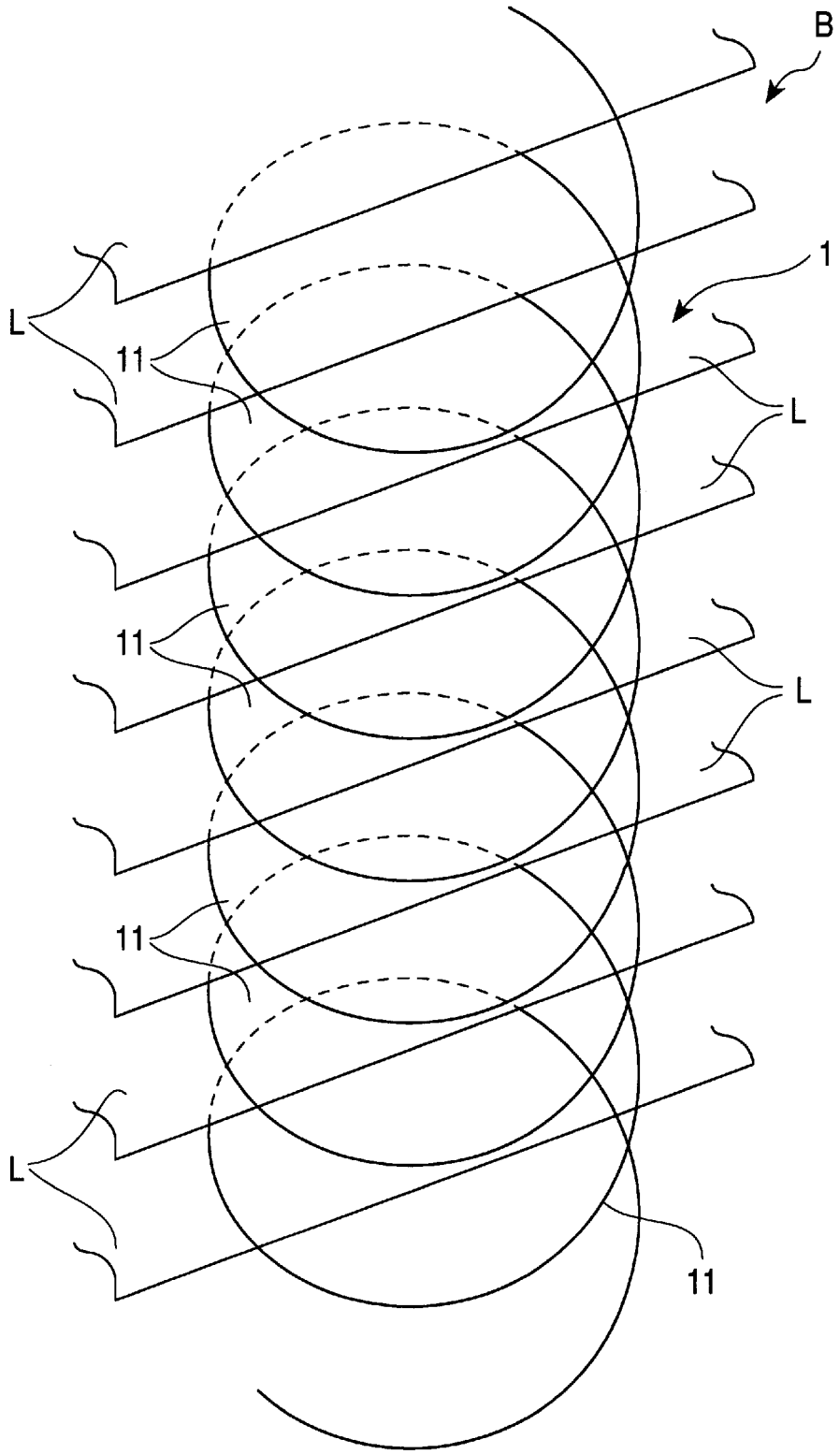
FIG. 2 is an illustrative perspective view of the blind which shows the offset ring-like portions of the coil-spring-like spacer inserted between adjacent louvers of the blind.
Figure 3:
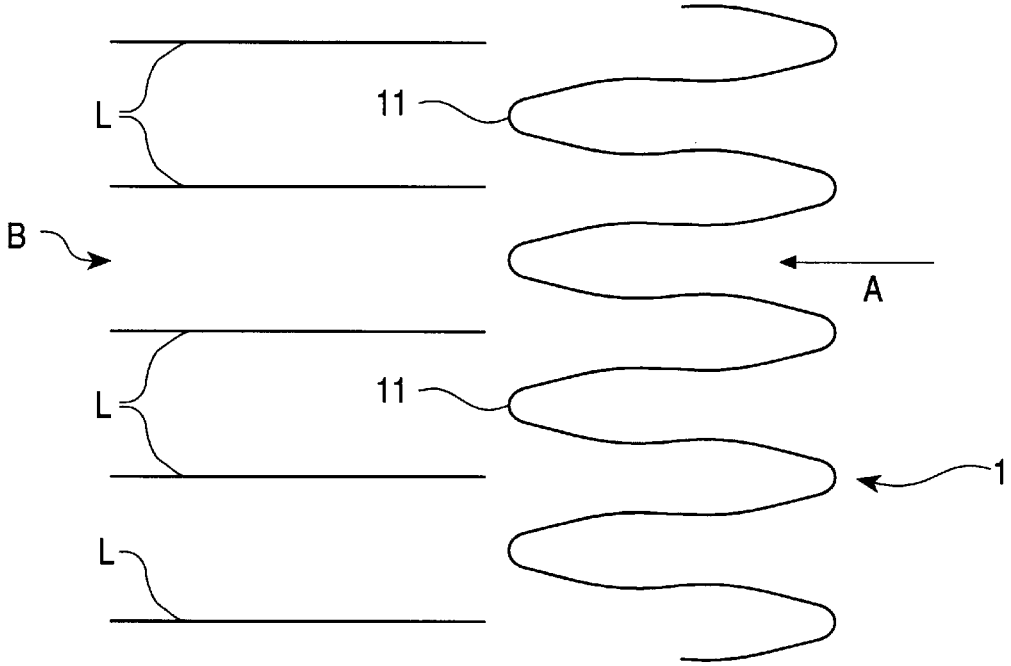
FIG. 3 is an illustrative side elevational view of the blind which shows a state in which the offset ring-like portions of the coil-spring-like spacer are disposed just before the adjacent louvers of the blind so as to be inserted therebetween.
Figure 4:
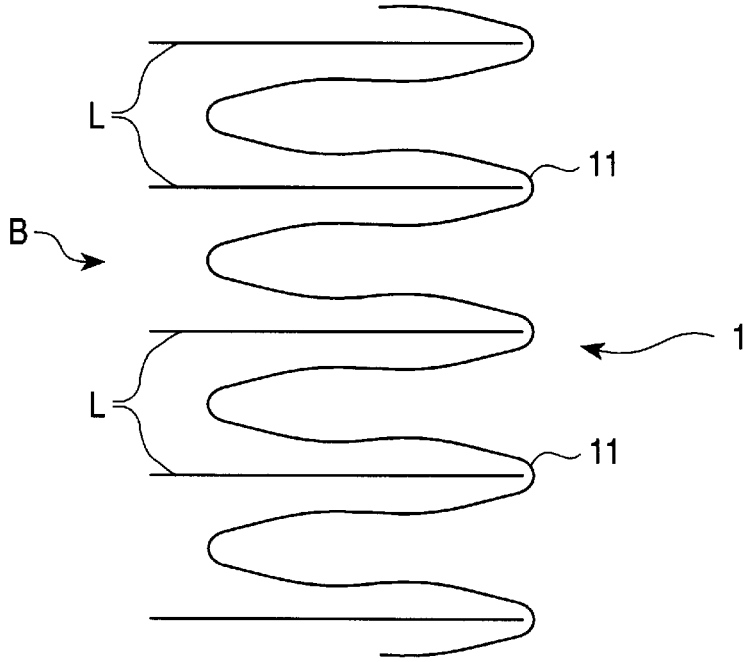
FIG. 4 is an illustrative side elevational view of the blind which shows a state in which the offset ring-like portions of the coil-spring-like spacers are inserted between the adjacent louvers of the blind.

The above-described operation will be explained in more detail. As shown in FIG. 3, when the coil-spring-like spacer 1 is brought into contact with the adjacent louvers L and the coil-spring-like spacer 1 is squeezed toward the louver L side in the direction of an arrow A, respective offset ring-like portions 11, of the coil-spring-like spacer 1 are inserted between the vertically adjacent louvers L as shown in FIG. 2 and FIG. 4.

The squeezing operation of the coil-spring-like spacer 1 in the direction of the arrow A can be simply performed by squeezing the coil-spring-like spacer 1 in the direction of the arrow A while sliding an operator's hand from above to below. Even though the respective offset ring-like portions 11 are slightly deviated from the distance between the blind B, since the coil-spring-like spacer 1 itself is constructed in the form of a spiral contour and has resiliency, the foregoing deviation disappears merely by thrusting the coil-spring-like spacer 1 in the direction of the arrow A, while sliding an operator's hand along the coil-spring-like spacer 1 from above to below, and thus the offset ring-like portions 11 are easily inserted between the corresponding louvers L.

Subsequently, a step of reducing the distance between the louvers, as represented by a step S2 in FIG. 13, will be executed.

Figure 5:
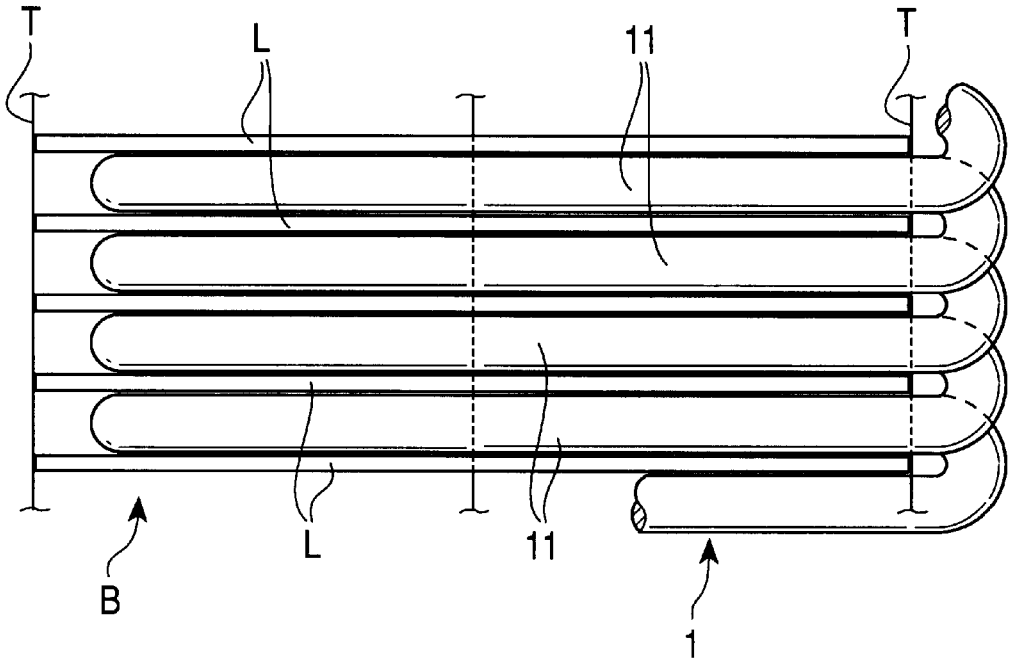
FIG. 5 is a fragmentary enlarged side elevational view of the blind which shows the offset ring-like portions of the coil-spring-like spacer inserted between the adjacent louvers while the blind is contracted.

As mentioned above, the blind B, vertically expanded to a maximum extent, is raised up from the lower portion thereof to reduce the distance between the louvers L in conformance with a manner of usage thereof. Since the offset ring-like portions 11 of the coil-spring-like spacer 1 are inserted between the vertically adjacent louvers L, as shown particularly in FIG. 2, the reducing action is regulated by the offset ring-like portions 11 and the distance between the louvers is reduced to a dimension of 2 mm, which corresponds to the diameter of the wire forming the offset ring-like portions. FIG. 5 shows the above-described state. Further, FIG. 6 and FIG. 7 show the blind B in which the distance between the vertically adjacent louvers L is reduced to the diameter of the wire of the coil-spring-like spacer 1, respectively.

Next, a step of washing the blind B will be executed.

First, as shown at step S3 of FIG. 13, the blind B is placed on the layer of fine particles 3, which have been charged into the inner bath 51 of the washing bath 5.

Figure 6:
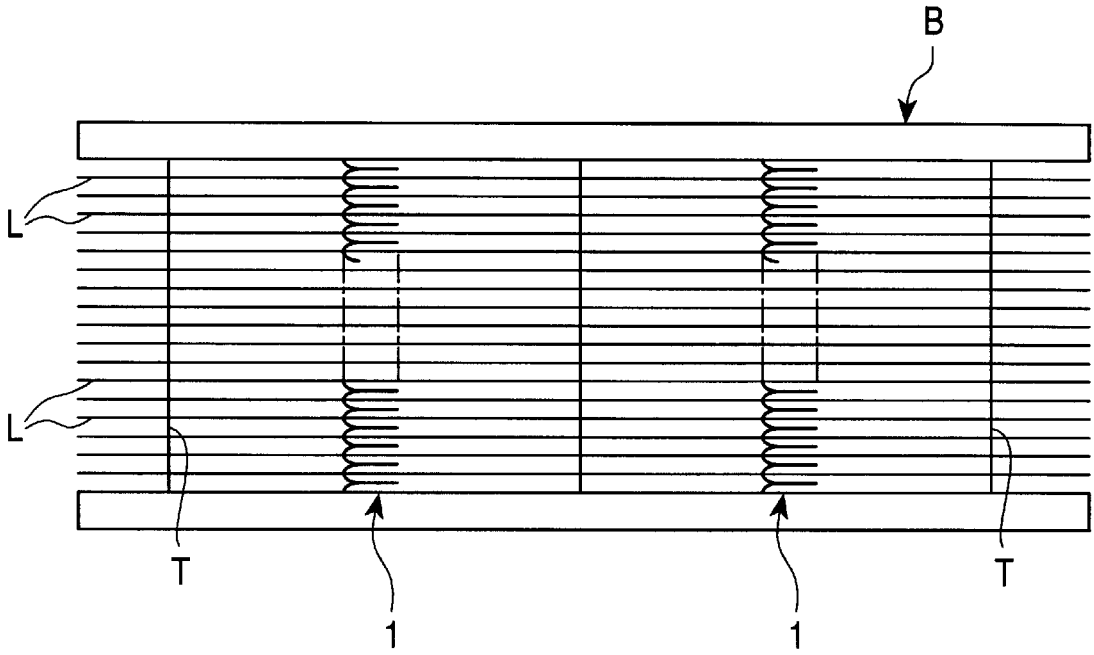
FIG. 6 is an illustrative front elevational view of the blind which shows the offset ring-like portions of the coil-spring-like spacer inserted between the adjacent louvers of the blind while the blind is contracted.
Figure 7:
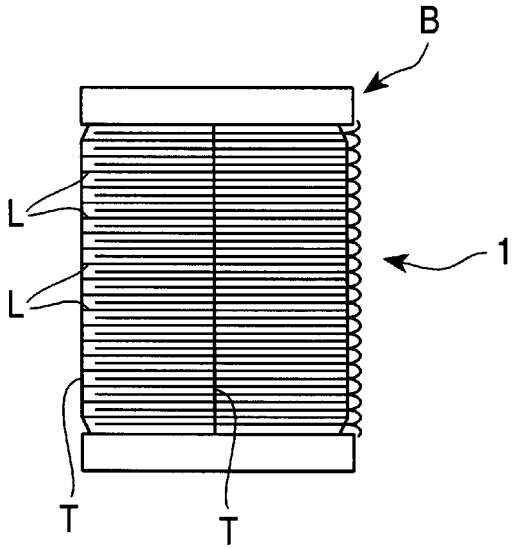
FIG. 7 is an illustrative side elevational view of the blind which shows the offset ring-like portions of the coil-spring-like spacer inserted between the adjacent louvers while the blind is contracted.

That is, the blind B, whose adjacent louvers L are contracted to have the minimum distance, is put into the inner bath 51 of the washing bath 5 filled with the mixed material 2 composed of the fine particles 3 and the detergent solution 4 while the distance is maintained as shown in FIG. 6 and FIG. 7. As shown in FIG. 8, two rubber-like elastic rings W are fitted around the contracted blind B at the positions near to both the side ends thereof. Hooks H are fixed to both the ends of a single rope R are locked to the respective rubber-like elastic rings W and the blind B is put into the inner bath 51 of the washing bath 5 while suspending the rope R in this state. The rope R has a length such that, even if the blind B sinks to the bottom of the inner bath 51 of the washing bath 5, the vicinity of the central portion of the rope is located externally of the inner bath 51.

Incidentally, the vibration generator 6 is not driven at this time, the respective particles are in the inter-particle-coupling state through the detergent solution 4 and in a solid state as a whole. Therefore, the blind B is placed on the upper surface layer of the fine particles 3 in the solid state thereof.

Thereafter, the washing operation of the blind B is executed by liquefying the fine particles 3 as shown at step S4 of FIG. 13.

When the vibration generator 6 is driven after the blind B is placed on the layer of the fine particles 3, a horizontal vibration is applied to the washing bath 5 as shown by the arrow Y in FIG. 9 and transmitted to the mixed material 2 in the inner bath 51. In the illustrated embodiment, the vibration generated by the vibration generator 6 at the time has a frequency set to 60 Hz and an amplitude set to 2.0 cm. When the vibration is applied to the mixed material 2 through the washing bath 5 as described above, liquefaction of the fine particles 3 is generated by the vibration.

At this time, the detergent solution 4 contained in the mixed material 2 is also vibrated by the vibration and repeatedly collides against the slide plates 511 of the inner bath 51 in the vicinities thereof. However, since the communicating holes 512 are open through the slide plates 511 at positions above the layer of fine particles 3 and lower than the upper surface of the detergent solution 4, a part of the detergent solution 4 collides against the slide plates 511 and moves into the outer bath 52 so that the stress resulting from the collision of the detergent solution 4 against the side plates 511 in the inner bath 51 can be dispersed. As a result, the bulging phenomenon of the surface layer of the fine particles 3, which would be caused in the inner bath 51 if the stress is not dispersed, can be suppressed.

The detergent solution 4, which has flown into the outer bath 52, returns into the inner bath 51 when it is vibrated in the direction opposite to that when it flows into the outer bath 52.

As shown in FIG. 9, the blind B, which is put on the upper surface layer of the solidified fine particles 3, sinks into the layer of the fine particles 3 due to its own weight as the fine particles 3 are liquefied. However, since the surface layer of the fine particles 3 does not bulge and is maintained in an approximately flat state, the blind B is entirely buried in the layer of fine particles 3.

After the blind B is buried in the layer of fine particles 3, the frequency of the vibration generated by the vibration generator 6 is lowered to 20 Hz in the illustrated embodiment. This is executed to increase the stress of the fine particles 3 to thereby increase the brushing effect performed by the fine particles 3 as mentioned below.

Accordingly, the surfaces of the louvers L of the blind B which is sunk into the layer of the fine particles 3 are subjected to a brushing action which is caused by the fine particles 3 which are moved in contact with the surfaces of the louvers L by the liquefaction so that the dirty materials D, deposited on the surfaces, can be speedily and satisfactorily removed.

This will be described below in more detail.

Figure 10:
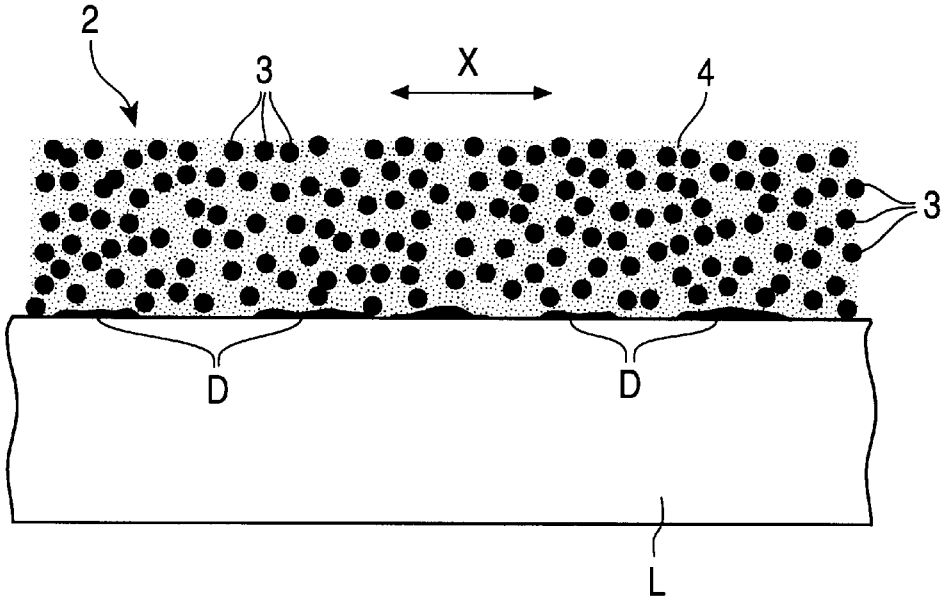
FIG. 10 is an illustrative view showing a state in which the dirty materials on the surface of the louvers are removed by the brushing action of the fine particles.

The fine particles 3 have a strong vibration component in the direction of the arrow Y (in FIG. 9) which is applied by the vibration generator 6 from the outside, and the blind B is put into the inner bath 51 of the washing bath 5 in parallel with the vibrating direction. Therefore, as shown in FIG. 10, the fine particles 3 make a motion having a large vibration component in the direction of an arrow X which is parallel to the arrow Y, and, in particular, the fine particles 3 in contact with the louvers L brush the surfaces of the louvers to thereby speedily remove the dirty materials D deposited on the surfaces of the louvers L.

At this time, since the silica sand, the surface layer of which is composed of the soft surface layer 32, is used as the fine particles 3 as shown in FIG. 15, there is no possibility that the surfaces of the louvers L will be injured by the brushing action.

The brushing action can be satisfactorily executed because the distance between vertically adjacent louvers L is set to about 2 mm by the coil-spring-like spacer 1 and the fine particles 3 can freely enter the gaps between the louvers. Further, the distance is near to a minimum extent which permits the blind B to be washed in a compactly folded state.

Further, since the blind B to be washed in the illustrated embodiment is used in an ordinary office, the content of dirty materials generally comprises dust, tar of tobacco and the like, the alkaline detergent solution is used as the detergent solution 4 to cope with this type of the dirty materials. Accordingly, a speedy and more satisfactory washing effect can be obtained due to the cooperation of the washing action performed by the detergent solution 4 and the brushing action performed by the fine particles 3.

The washing effect of the blind B can be obtained in about 2 minutes after the vibration is generated by the vibration generator 6 and the fine particles 3 are liquefied. Therefore, the elapsed time of 2 minutes is measured and the blind B is pulled up from the inner bath 51 of the washing bath 5 by making use of the rope R. The blind B is pulled up without stopping the operation of the vibration generator 6 while the liquefaction of the fine particles is generated because, if the operation of the vibration generator 6 is stopped, the inter-particle coupling of the fine particles 3 is caused and it is difficult to pull up the blind.

After the completion of the washing step, a rinsing step will be executed as shown at step S5 of FIG. 13.

The washed blind B is placed in the rinsing bath 8 and rinsed therein. That is, the rinsing step is executed by sinking the washed blind B in the rinsing liquid 9 in the rinsing bath 8 once, moving it slightly and then pulling it up as shown in FIG. 11.

Thereafter, a step for disconnecting the coil-spring-like spacer 1 from the blind B will be executed as shown at step S6 of FIG. 13.

Figure 12:
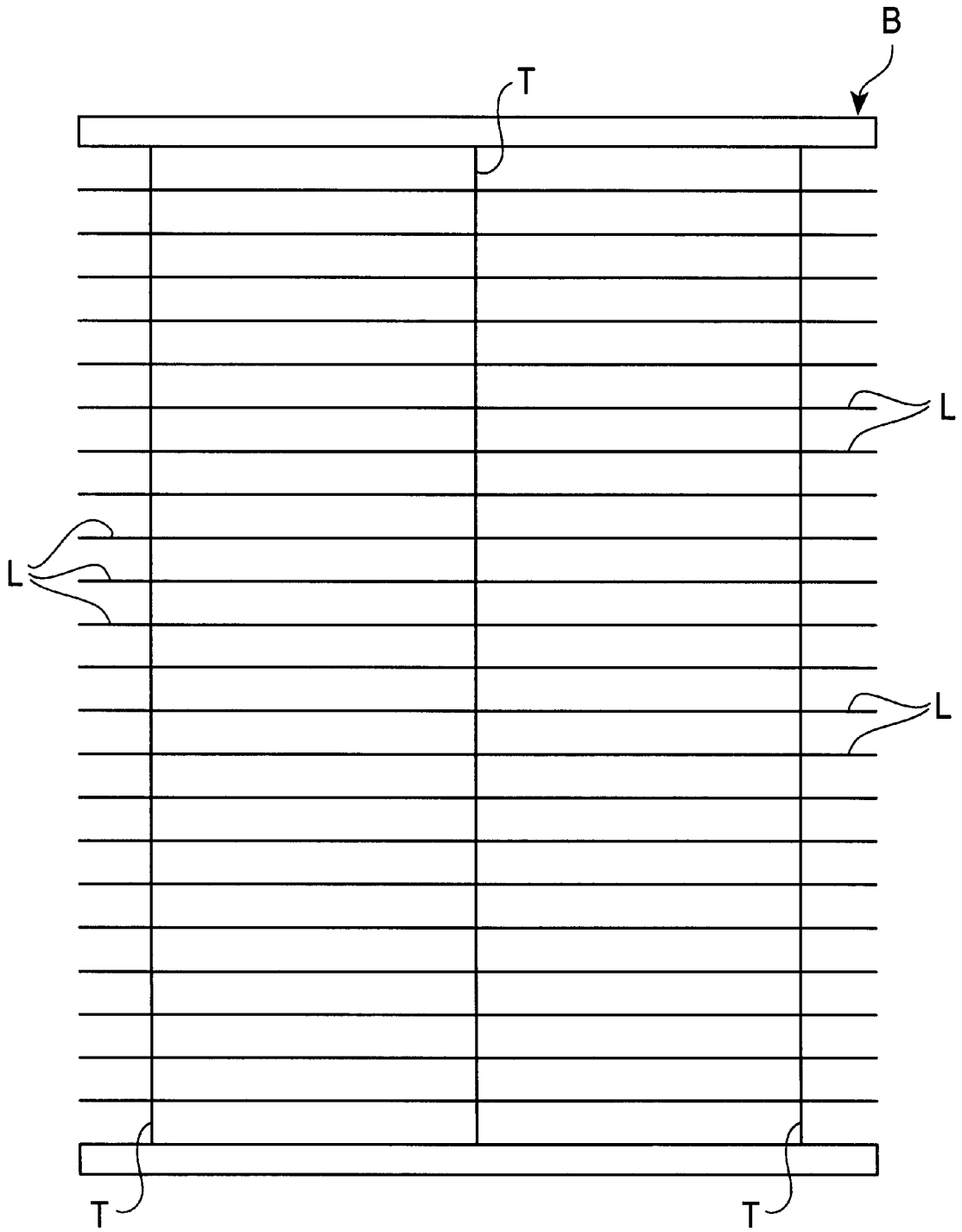
FIG. 12 is an illustrative schematic front elevational view showing a state in which the washed blind is expanded and the coil-spring-like spacer is disconnected therefrom.

First, the upper end of the rinsed blind B is engaged with a not shown engagement means located at a high position, the distance between the adjacent louvers is enlarged by expanding the blind B in conformance with a manner of usage, and the coil-spring-like spacers 1 are disconnected from the blind B as shown in FIG. 12. Note, FIG. 12 shows a state following the disconnection of the coil-spring-like spacers 1.

Next, a step for drying the blind B will be executed as shown at step S7 of FIG. 13.

The blind B from which the coil-spring-like spacers 1 are disconnected is dried by being left in the expanded state. Since the aqueous solution containing the rinsing agent and the draining agent is used as the rinsing liquid 9 in the illustrated embodiment, water is satisfactorily drained from the blind B and the blind B can be quickly dried.

What is claimed is:

1. A method of washing a blind, the method comprising:

enlarging a distance between adjacent louvers of a blind to be washed, each of the louvers being held in a horizontal orientation;

squeezing a spacer against the blind so as to insert offset portions of the spacer between the adjacent louvers, wherein the spacer is disposed at right angles relative to the louvers, and the spacer has a shape of a spiral coil and is formed of a wire having a diameter;

reducing the distance between adjacent louvers of the blind so as to hold the offset portion of the spacer in a clamped state such that a gap, corresponding to the wire diameter, is formed between the adjacent louvers;

placing the blind in a washing bath filled with a mixture of liquid and fine particles of material, wherein each of the fine particles of material has a surface layer that is softer than the surfaces of the louvers;

applying a varying external force to the fine particles to liquefy the fine particles of material so that dirty materials on the surfaces of the louvers of the blind are removed by a brushing action of the liquefied fine particles of material; and disconnecting the spacer from the washed blind.

2. The method as claimed in claim 1, wherein the liquid is a detergent solution selected in view of materials deposited on the surfaces of the louvers, the method further comprises rinsing the washed blind prior to disconnecting the spacer from the washed blind.

3. The method as claimed in claim 1, wherein the liquid is a detergent solution selected in view of materials deposited on the surfaces of the louvers, the method further comprises rinsing the blind after disconnecting the spacer from the washed blind.

4. A method of washing a blind, the method comprising:

enlarging a distance between adjacent louvers of a blind to be washed, each of the louvers being held in a horizontal orientation;

squeezing a spacer against the blind so as to insert offset portions of the spacer between the adjacent louvers, wherein the spacer is disposed at right angles relative to the louvers, and the spacer has a shape of a spiral coil and is formed of a wire having a diameter;

reducing the distance between adjacent louvers of the blind so as to hold the offset portion of the spacer in a clamped state such that a gap, corresponding to the wire diameter, is formed between the adjacent louvers;

placing the blind in a washing bath filled with a mixture of liquid and fine particles of silica sand having a particle size of 0.5 mm to 0.8 mm, wherein the particles of silica sand have been subjected to a softening process so that each of the particles has a surface layer that is softer than the surfaces of the louvers;

applying a varying external force to liquefy the fine particles of silica sand so that dirty materials on the surfaces of the louvers of the blind are removed by a brushing action of the liquefied fine particles of silica sand; and disconnecting the spacer from the washed blind.

5. The method as claimed in claim 4, wherein the softening process includes dipping the silica sand into a caustic soda solution, and modifying the surface with sodium silicate.

6. A method of washing a blind, the method comprising:

enlarging a distance between adjacent louvers of a blind to be washed, each of the louvers being held in a horizontal orientation;

squeezing a spacer against the blind so as to insert offset portions of the spacer between the adjacent louvers, wherein the spacer is disposed at right angles relative to the louvers, and the spacer has a shape of a spiral coil and is formed of a wire having a diameter;

reducing the distance between adjacent louvers of the blind so as to hold the offset portion of the spacer in a clamped state such that a gap, corresponding to the wire diameter, is formed between the adjacent louvers;

placing the blind in a washing bath filled with a mixture of liquid and a layer of fine particles of material, wherein the washing bath comprising an outer bath, an inner bath disposed in the outer bath, and a plurality of communicating holes formed in side walls of the inner bath at positions that are higher than an upper surface of the layer fine particles of material and lower than an upper surface of the liquid;

liquefying the fine particles of material by applying a varying external force to the fine particles of material via the inner bath so that dirty materials on the surfaces of the louvers of the blind are removed by a brushing action of the liquefied fine particles of material; and disconnecting the spacer from the washed blind.

7. A method of washing a blind, the method comprising:

enlarging a distance between adjacent louvers of a blind to be washed, each of the louvers being held in a horizontal orientation;

squeezing a spacer against the blind so as to insert offset portions of the spacer between the adjacent louvers, wherein the spacer is disposed at right angles relative to the louvers, and the spacer has a shape of a spiral coil and is formed of a wire having a diameter;

reducing the distance between adjacent louvers of the blind so as to hold the offset portion of the spacer in a clamped state such that a gap, corresponding to the wire diameter, is formed between the adjacent louvers;

placing the blind into a washing bath filled with a mixture of liquid and fine particles of material;

liquefying the fine particles of material by applying a varying external force, at a first varying frequency, to the fine particles of material;

reducing the frequency of the varying external force to a lower varying frequency after the blind becomes buried in the liquefied fine particles of material so that dirty materials on the surfaces of the louvers of the blind are removed by a brushing action of the liquefied fine particles of material; and disconnecting the spacer from the washed blind.

8. A method of washing a blind, the method comprising:

enlarging a distance between adjacent louvers of a blind to be washed, each of the louvers being held in a horizontal orientation;

squeezing a spacer against the blind so as to insert offset portions of the spacer between the adjacent louvers, wherein the spacer is disposed at right angles relative to the louvers, and the spacer has a shape of a spiral coil and is formed of a wire having a diameter;

reducing the distance between adjacent louvers of the blind so as to hold the offset portion of the spacer in a clamped state such that a gap, corresponding to the wire diameter, is formed between the adjacent louvers;

placing the blind into a washing bath filled with a mixture of liquid and fine particles of material; and liquefying the fine particles of material by applying an external vibrating force to the fine particles of material so that dirty materials on the surfaces of the louvers are removed by a brushing action of the liquefied fine particles of material; and disconnecting the spacer from the washed blind.

9. The method as claimed in claim 8, wherein the external vibrating force is initially applied at a first frequency to cause the liquefaction of the fine particles of material, and then after the blind becomes buried in the liquefied fine particles of material, the frequency of the external vibrating force is reduced from the first frequency to a lower frequency so that dirty materials on the surfaces of the louvers are removed by a brushing action of the fine particles of material.

* * * * *